US011101057B2

(12) United States Patent
Wu et al.

(10) Patent No.: US 11,101,057 B2
(45) Date of Patent: Aug. 24, 2021

(54) HIGHLY THERMOSTABLE RARE-EARTH PERMANENT MAGNETIC MATERIAL, PREPARATION METHOD THEREOF AND MAGNET CONTAINING THE SAME

(71) Applicant: GRIREM ADVANCED MATERIALS CO., LTD., Beijing (CN)

(72) Inventors: Guiyong Wu, Beijing (CN); Yang Luo, Beijing (CN); Hongwei Li, Beijing (CN); Yuanfei Yang, Beijing (CN); Dunbo Yu, Beijing (CN); Ningtao Quan, Beijing (CN); Chao Yuan, Beijing (CN); Wenlong Yan, Beijing (CN)

(73) Assignee: GRIREM ADVANCED MATERIALS CO., LTD., Beijing (CN)

( * ) Notice: Subject to any disclaimer, the term of this patent is extended or adjusted under 35 U.S.C. 154(b) by 399 days.

(21) Appl. No.: 15/868,063

(22) Filed: Jan. 11, 2018

(65) Prior Publication Data

US 2018/0268971 A1 Sep. 20, 2018

(30) Foreign Application Priority Data

Mar. 17, 2017 (CN) ..... 201710161808.1

(51) Int. Cl.

| | |
|---|---|
| ***C22C 38/00*** | (2006.01) |
| ***H01F 1/059*** | (2006.01) |
| ***C23C 8/24*** | (2006.01) |
| ***H01F 1/08*** | (2006.01) |
| ***C22C 38/02*** | (2006.01) |
| ***C22C 38/04*** | (2006.01) |
| ***C22C 38/06*** | (2006.01) |
| ***C22C 38/10*** | (2006.01) |
| ***C22C 38/12*** | (2006.01) |
| ***C22C 38/14*** | (2006.01) |
| ***C22C 38/28*** | (2006.01) |
| ***C23C 8/26*** | (2006.01) |
| ***H01F 41/02*** | (2006.01) |
| *C22C 33/02* | (2006.01) |
| *B22F 9/04* | (2006.01) |
| *B22F 9/08* | (2006.01) |
| *B22F 3/02* | (2006.01) |
| *B22F 5/00* | (2006.01) |
| *B22F 1/00* | (2006.01) |

(52) U.S. Cl.

CPC ..... *H01F 1/0596* (2013.01); *C22C 38/001* (2013.01); *C22C 38/005* (2013.01); *C22C 38/02* (2013.01); *C22C 38/04* (2013.01); *C22C 38/06* (2013.01); *C22C 38/10* (2013.01); *C22C 38/12* (2013.01); *C22C 38/14* (2013.01); *C22C 38/28* (2013.01); *C23C 8/24* (2013.01); *C23C 8/26* (2013.01); *H01F 1/083* (2013.01); *H01F 41/0266* (2013.01); *B22F 1/0059* (2013.01); *B22F 1/0085* (2013.01); *B22F 1/0088* (2013.01); *B22F 3/02* (2013.01); *B22F 5/00* (2013.01); *B22F 9/04* (2013.01); *B22F 2003/023* (2013.01); *B22F 2009/048* (2013.01); *B22F 2009/0812* (2013.01); *B22F 2201/02* (2013.01); *B22F 2201/11* (2013.01); *B22F 2998/10* (2013.01); *B22F 2999/00* (2013.01); *C22C 33/0257* (2013.01); *C22C 2202/02* (2013.01)

(58) Field of Classification Search

CPC ... H01F 1/0596; C22C 38/001; C22C 38/005; C22C 38/02; C22C 38/04; C22C 38/05; C22C 38/06; C22C 38/10; C22C 38/12; C22C 38/14

See application file for complete search history.

(56) References Cited

U.S. PATENT DOCUMENTS

| | | | | |
|---|---|---|---|---|
| 5,395,459 | A * | 3/1995 | Pinkerton | H01F 1/059 148/101 |
| 5,750,044 | A * | 5/1998 | Yoneyama | H01F 1/0596 148/301 |
| 2002/0014283 | A1 | 2/2002 | Iriyama et al. | |
| 2010/0261038 | A1 | 10/2010 | Imaoka et al. | |
| 2013/0020527 | A1 | 1/2013 | Li et al. | |
| 2017/0005553 | A1* | 1/2017 | Mio | C22C 38/001 |

FOREIGN PATENT DOCUMENTS

| | | | |
|---|---|---|---|
| CN | 1326200 | A | 12/2001 |
| CN | 1254338 | * | 12/2002 |
| CN | 1953110 | A | 4/2007 |
| CN | 102047536 | A | 5/2011 |
| CN | 102208234 | A | 10/2011 |
| CN | 102468028 | A | 5/2012 |
| CN | 103624248 | A | 3/2014 |
| CN | 106312077 | A | 1/2017 |
| DE | 4126893 | A1 | 5/1992 |
| DE | 60129507 | T2 | 4/2008 |
| DE | 112011100406 | T5 | 11/2012 |
| DE | 112012006640 | T5 | 4/2015 |

(Continued)

OTHER PUBLICATIONS

Saito. Magnetic properties of Sm—Fe—N bulk magnets prepared from Sm2Fe17N3 meltspun ribbons. J. Appl. Phys. 117, 17D130 (2015).*

*Primary Examiner* — Matthew E. Hoban

(74) *Attorney, Agent, or Firm* — Shumaker, Loop & Kendrick, LLP; James D. Miller

(57) ABSTRACT

Provided are a highly thermostable rare-earth permanent magnetic material, a preparation method thereof and a magnet containing the same. A composition of the rare-earth permanent magnetic material by an atomic percentage is as follows: $Sm_xR_aFe_{100-x-y-z-a}M_yN_z$, wherein R is at least one of Zr and Hf, M is at least one of Co, Ti, Nb, Cr, V, Mo, Si, Ga, Ni, Mn and Al, x+a is 7-10%, a is 0-1.5%, y is 0-5% and z is 10-14%.

14 Claims, No Drawings

(56) References Cited

FOREIGN PATENT DOCUMENTS

| | | | | |
|---|---|---|---|---|
| JP | H0316018 | A | | 1/1991 |
| JP | H0997732 | A | | 4/1997 |
| JP | 2000348921 | A | | 12/2000 |
| JP | 2002057017 | A | | 2/2002 |
| JP | 2002057017 | | * | 5/2002 |
| JP | 2012106264 | A | | 6/2012 |
| JP | 2013531359 | A | | 8/2013 |
| WO | 2014190558 | A1 | | 12/2014 |

* cited by examiner

HIGHLY THERMOSTABLE RARE-EARTH PERMANENT MAGNETIC MATERIAL, PREPARATION METHOD THEREOF AND MAGNET CONTAINING THE SAME

CROSS-REFERENCE TO RELATED APPLICATIONS

This application claims priority to Chinese Patent Application No. 201710161808.1 filed on Mar. 17, 2017, the disclosure of which is incorporated herein by reference in its entirety.

TECHNICAL FIELD

The present application belongs to the field of rare-earth permanent magnetic materials, and more particularly, relates to a highly thermostable rare-earth permanent magnetic powder, a preparation method thereof and a magnet containing the same.

BACKGROUND

The rare-earth permanent magnetic material refers to a permanent magnetic material prepared by means of a certain process from an alloy formed by a rare-earth metal and a transition metal. It is the permanent magnetic material presently known with the highest overall performance, for example, its magnetic property is one hundred or more times of a magnetic steel used in 1990s, it's properties are much superior to a ferrite and an aluminum-nickel-cobalt and even its magnetic property is one time higher than an expensive platinum-cobalt alloy. Thanks to the use of the rare-earth permanent magnetic material, not only is the development of a permanent magnetic device accelerated to the miniaturization and the product performance improved, but the generation of some special device is also promoted. Therefore, once the rare-earth permanent magnetic material is emerged, it obtains a great concern immediately and develops very quickly. Up to now, the rare-earth permanent magnetic material has been widely applied in the field of machinery, electronics, instrumentation and medicine, etc.

In 1990, Hong Sun and Coey et.al synthesized an interstitial atom intermetallic compound $Sm_2Fe_{17}N_x$ by employing a gas-solid phase reaction and it had an extremely high anisotropic field (14 T) and a good temperature resistance. A $TbCu_7$ type isotropic samarium-iron-nitrogen was first found by German Katter et. al in 1991 and its atom approximation ratio was $SmFe_9N_x$. The $TbCu_7$ type isotropic samarium-iron-nitrogen has characteristics such as high saturated magnetization intensity (1.7 T), high Curie temperature (743 K) and good corrosion resistance. Compared with the quick-quenched neodymium-iron-boron, under the condition of a stable process, its comprehensive cost is lower and therefore it is considered as a potential new generation of the rare-earth permanent magnetic material. A bonded magnet prepared from the isotropic samarium-iron-nitrogen magnetic powder not only has a high magnetic property, but also can reduce a required magnetic volume and has a good corrosion resistance and can be applied to the field of micro motor, sensor and starter, etc. However, when the bonded magnet prepared from the isotropic samarium-iron-nitrogen magnetic powder is used under a relatively high temperature, there exist problems such as the magnetic property is reduced and the flux loss is generated. Hence, the research and the development of a highly thermostable isotropic samarium-iron-nitrogen are of practical significance.

JP 2002057017 discloses a series of isotropic samarium-iron-nitrogen having a main phase of a $TbCu_7$ structure and a magnetic property thereof. A samarium-iron alloy is prepared by employing melt quick quenching and after nitridation, its magnetic energy product is up to 12-18 MGOe. However, the coercivity of most magnetic powder still is below 10 kOe. In this patent, the magnetic property of the nitrided magnetic powder after treatment at different heat treatment temperatures of 500-900° C. is achieved, but attentions are not paid to the change of a phase structure and the influence on thermostability of the magnetic powder. CN 102208234A discloses an element for improving wettability of a quick-quenched SmFe alloy liquid by doping so as to get an amorphous ribbon more easily and form a $TbCu_7$ metastable phase better, but yet, how to improve the thermostability is not mentioned. U.S. Pat. No. 5,750,044 discloses an isotropic SmFeCoZrN magnetic powder which has the magnetic property close to NdFeB; in this magnetic powder, multiple phase structures containing $TbCu_7$, $Th_2Zn_{17}$, $Th_2Ni_{17}$ and α-Fe are allowed, but the influence of the contents of $Th_2Zn_{17}$ and $Th_2Ni_{17}$ type phases on the performance of the magnetic powder is not concerned.

The anisotropic $Sm_2Fe_{17}N_x$ magnetic powder has high coercivity and magnetic energy product and its preparation method mainly includes a melt quick quenching method, a mechanical alloying method, an HDDR, a powder metallurgical method, a reduction-diffusion method and the like. The anisotropic $Sm_2Fe_{17}N_x$ magnetic powder has an excellent intrinsic coercivity and a higher service temperature. However, these processes all require preparing a single-phase master alloy first and then nitriding to obtain the $Sm_2Fe_{17}N_x$ magnetic powder. Moreover, particles of the magnetic powder need to be close to a single-domain size such that the relatively high magnetic property can be obtained. Therefore, the preparation process is complex and the cost is relatively high.

CN 1953110A discloses a bond-type samarium-iron-nitrogen and neodymium-iron-nitrogen composite permanent magnetic material. Though the material herein has good magnetic property, temperature resistance and oxidation resistance, the preparation method is only by means of compositing and bonding different magnetic powders and does not improve the thermostability from the perspective of microstructure design. Likewise, CN 106312077A discloses a submicron anisotropic samarium-iron-nitrogen magnetic powder and a hybridized bonded magnet thereof. The magnetic property of a magnet and a composite magnet is also improved by employing the high-performance monocrystalline anisotropic samarium-iron-nitrogen from the perspective of compositing, and the preparation process of monocrystalline particle samarium-iron-nitrogen magnetic powder is still relatively complex and the cost is relatively high. Furthermore, the compositing manner still is physical mixing and bonding.

Quick-quenched SmFe alloys prepared at different wheel speeds are disclosed in "Journal of applied physics" 70.6 (1991): 3188-3196. By means of quenching and nitriding treatments, the magnetic property of the magnetic powder is achieved and the magnetic powder having $Th_2Zn_{17}$ type and $TbCu_7$ type crystal structures is obtained. According to the article, it is recommended to select the $Th_2Zn_{17}$ type (21 kOe) with the high coercivity and indicated that, for a practical magnet, there is a need for the $TbCu_7$ type structure to further improve the coercivity and to reduce the size of $TbCu_7$ type crystal grains.

SUMMARY

In light of this, a first objective of the present application is to provide a highly thermostable isotropic rare-earth permanent magnetic powder. The rare-earth permanent magnetic powder provided by the present application has a temperature resistance and a corrosion resistance.

To this end, the following technical means are adopted by the present application.

A composition of a rare-earth permanent magnetic material by an atomic percentage is as follows:

$$Sm_xR_aFe_{100-x-y-z-a}M_yN_z$$

Wherein R is at least one of Zr and Hf, M is at least one of Co, Ti, Nb, Cr, V, Mo, Si, Ga, Ni, Mn and Al, x+a is 7-10%, a is 0-1.5%, y is 0-5% and z is 10-14%. The above ranges all include an endpoint value, and N is a nitrogen element.

Preferably, the rare-earth permanent magnetic material includes a $TbCu_7$ phase, optionally, a $Th_2Zn_{17}$ phase and a soft magnetic phase α-Fe.

Preferably, the content of the $TbCu_7$ phase in the rare-earth permanent magnetic material is 50% or more, preferably 80% or more and further preferably 95% or more.

Preferably, the content of the $Th_2Zn_{17}$ phase in the rare-earth permanent magnetic material is 0-50%, excluding 0 and preferably 1-50%.

Preferably, the content of the soft magnetic phase α-Fe in the rare-earth permanent magnetic material is 0-5%, excluding 0.

Preferably, the rare-earth permanent magnetic material is composed of crystal grains having an average size of 10 nm to 1 μm, preferably 10-200 nm.

The magnetic property Hcj of the rare-earth permanent magnetic material provided by the present application reaches to 10 kOe or more and the magnetic energy product Bh is 14 MGOe or more. The irreversible flux loss of a magnet prepared from the rare-earth permanent magnetic material of the present application is less than 5% (the thermostability is characterized by means of the irreversible flux loss of a bonded magnet, by exposing for 2 h in the air at 120° C.).

A second objective of the present application is to provide a preparation method of the rare-earth permanent magnetic material, including the following steps:

(1) performing master alloy smelting on Sm, R, Fe and M;

(2) quick-quenching a master alloy obtained in the step (1) to prepare a quick-quenched ribbon;

(3) performing a crystallization treatment on the quick-quenched ribbon obtained in the step (2); and (4) nitriding the permanent magnetic material crystallized in the step (3) to obtain the rare-earth permanent magnetic material.

To improve the magnetic property and the thermostability of the isotropic samarium-iron-nitrogen magnetic powder from the design of a microstructure of the material in itself, the crystallization treatment method with a low cost and a simple process is researched and developed by the present application. A high-coercivity second phase is introduced to improve the intrinsic coercivity of the magnetic powder, such that the samarium-iron-nitrogen magnetic powder having a certain practical application value is obtained. The isotropic samarium-iron-nitrogen magnetic powder in the present application is obtained mainly by means of the samarium-iron ribbon prepared via quick quenching, by adjusting the structure of an alloy phase via a heat treatment and at last by a nitriding effect.

Preferably, the smelting in the step (1) is performed by means of an intermediate frequency or an electric arc, etc.

Preferably, an ingot obtained by the smelting is preliminarily crushed into millimeter-level ingot blocks.

Preferably, the quick-quenching process in the step (2) is as follows: putting the master alloy into a quartz tube having a nozzle, smelting into an alloy liquid via induction smelting, and spraying to a rotary water-cooling copper mould via the nozzle to obtain the quick-quenched ribbon.

Preferably, a wheel speed in the quick-quenching is 20-80 m/s, preferably 40-50 m/s.

Preferably, the width of the quick-quenched ribbon is 0.5-8 mm, preferably 1-4 mm, and the thickness is 10-40 μm.

Preferably, the crystallization treatment in the step (3) is as follows: after wrapping the quick-quenched ribbon, performing a heat treatment and then a quenching treatment.

Preferably, the heat treatment is performed in a tubular resistance furnace.

Preferably, the heat treatment is performed in an argon atmosphere.

Preferably, a water cooling manner is adopted by the quenching treatment.

Preferably, a temperature of the heat treatment is 700-900° C. and a time is 5 min or more, preferably 10-90 min.

Preferably, the material after the crystallization treatment in the step (3) is crushed.

Preferably, the material is crushed to 50 meshes or more, preferably 80 meshes or more.

Preferably, the nitriding in the step (4) is performed in a nitriding furnace.

Preferably, the nitriding is performed in a high-purity nitrogen atmosphere at 1-2 atm, preferably 1.4 atm.

Preferably, a temperature of the nitriding is 350-600° C., preferably 430-470° C. and a time is for 12 h or more, preferably 24 h.

Preferably, the preparation method of the rare-earth permanent magnetic material of the present application includes the following steps:

(1) batching a samarium iron and an element doped pure metal according to a certain proportion, uniformly smelting by means of an immediate frequency, an electric arc and the like to obtain a master alloy ingot and preliminarily crushing the ingot to obtain several mm-level ingot blocks;

(2) putting small master alloy ingot blocks into a quartz tube having a nozzle, smelting into an alloy liquid via induction smelting and spraying to a rotary water-cooling copper mould at a wheel speed of 40-50 m/s via a nozzle to obtain a quick-quenched ribbon which is 1-4 mm wide and 10-40 μm thick;

(3) after wrapping the quick-quenched SmFe ribbon with a tantalum thin film, putting into a tubular resistance furnace for a heat treatment at 700-900° C. for 10-90 min and then performing a quenching treatment by employing a water-cooling manner in an argon atmosphere; and (4) crushing a sample obtained in the step (3) to 80 meshes or more, placing with an iron cup, putting into a nitriding furnace and performing a nitriding treatment in a 1.4 atm high-purity nitrogen atmosphere at 430-470° C. for 24 h to obtain the target product.

A third object of the present application is to provide a magnet, which includes the rare-earth permanent magnetic material of the present application.

Preferably, the magnet is formed by bonding the rare-earth permanent magnetic material of the present application and an adhesive.

Preferably, the magnet is prepared with the following method: mixing the rare-earth permanent magnetic material of the present application with an epoxy resin to obtain a mixture, adding a lubricant to the mixture, then performing a treatment to obtain a bonded magnet, and at last thermocuring the bonded magnet.

Preferably, a proportion of the rare-earth permanent magnetic material to the epoxy resin by weight is 100:1-10, preferably 100:4.

Preferably, an added amount of the lubricant is 0.2-1 wt %, preferably 0.5 wt %.

Preferably, the treatment is a method such as mould pressing, injection, calendaring or extrusion.

Preferably, the mould pressing is performed by a tablet press.

The prepared bonded magnet may be of a blocky shape, an annular shape or other shapes, such as φ10*7 mm bonded magnet.

Preferably, a temperature of the thermocuring is 150-200° C., preferably 175° C. and a time is 0.5-5 h, preferably 1.5 h.

The rare-earth permanent magnetic material provided by the present application has excellent temperature resistance and corrosion resistance, is beneficial to further miniaturization of a device and is beneficial to use of the device under a special environment; the preparation method of the rare-earth permanent magnetic material provided by the present application has simple process and low cost; and the practical value of the prepared isotropic samarium-iron-nitrogen magnetic material can be improved.

DETAILED DESCRIPTION OF THE EMBODIMENTS

To understand the present application easily, the embodiments listed by the present application are set forth hereinafter. A person skilled in the art should know that the embodiments are only for a further understanding of the present application, rather than specific limits to the present application.

It is to be noted that the embodiments of the present application and the characteristics of the embodiments may be combined with each other if there is no conflict. The present application will be described below with reference to the embodiments in detail.

It is to be noted that terms herein are only intended to describe the specific embodiments, but not limit the exemplary embodiments of the present application. As described here, unless otherwise explicitly specified by the context, any singular form also includes a plural form. Additionally, it is to be understood that when terms "contain" and/or "include" are used in the description, it refers to that there exists a characteristic, a step, a device, a component and/or their combinations.

The present application provides a rare-earth permanent magnetic material; a composition of the rare-earth permanent magnetic material by an atomic percentage is as follows:

$$Sm_xR_aFe_{100-x-y-z-a}M_yN_z$$

Wherein R is at least one of Zr and Hf, M is at least one of Co, Ti, Nb, Cr, V, Mo, Si, Ga, Ni, Mn and Al, x+a is 7-10%, a is 0-1.5%, y is 0-5% and z is 10-14%. The above ranges all include an endpoint value, and N is a nitrogen element.

In the present application, the content of the rare-earth element Sm has a great influence on a phase structure of the quick-quenched SmFe alloy ribbon. It is easy to form the soft magnetic phase when the Sm content is below 7 at % and to form a samarium-enriched phase when the Sm content is 10 at % or more, all of which are not beneficial to preparing the quick-quenched alloy having 95% or more of the main phase of the $TbCu_7$ structure. Moreover, the Zr or the Hf may substitute the Sm element and the substituted amount is below 1.5 at %. With the substitution of the M element to the Fe element, the Sm/Fe proportion to form the $TbCu_7$ may be expanded. The Sm content in the present application is 7-10 at % preferably.

The magnetic property Hcj of the rare-earth permanent magnetic material provided by the present application reaches to 10 kOe or more and the magnetic energy product Bh is 14 MGOe or more. The irreversible flux loss of a magnet prepared from the rare-earth permanent magnetic material of the present application is less than 5% (the thermostability is characterized by means of the irreversible flux loss of a bonded magnet, by exposing for 2 h in the air at 120° C.).

The present application further provides a preparation method of the rare-earth permanent magnetic material, including the following steps:

(1) performing master alloy smelting on Sm, R, Fe and M;

(2) quick-quenching a master alloy obtained in the step (1) to prepare a quick-quenched ribbon;

(3) performing a crystallization treatment on the quick-quenched ribbon obtained in the step (2); and (4) nitriding a permanent magnetic material crystallized in the step (3) to obtain the rare-earth permanent magnetic material.

In the above preparation process, the critical step is the crystallization treatment on the quick-quenched ribbon in the step (3). The quick-quenched Sm Fe alloy contains a $TbCu_7$ type $SmFe_9$ phase, a few soft magnetic phase α-Fe and an amorphous phase, and there are vacancies and defects remained due to rapid cooling in the structure, so by virtue of the crystallization heat treatment, the amorphous structure is changed into a crystal structure on one hand, and on the other hand, the homogeneity of the microstructure is improved. In the crystallization heat treatment at a relatively low temperature, while the $TbCu_7$ type structure is formed, a few soft magnetic phase α-Fe is produced. The crystal grains in the structure are relatively small, so the remanence and the magnetic energy product of the samarium-iron-nitrogen magnetic powder are relatively high, but the coercivity still is relatively low.

It is found by the inventors that, under the experimental conditions, when the temperature of the crystallization heat treatment is relatively low and the time is relatively short, less $TbCu_7$ type metastable phase in the alloy is transformed into a $Th_2Zn_{17}$ type oblique hexagonal phase. On the contrary, when the temperature is raised and the treatment time is increased, more $TbCu_7$ type metastable phase is transformed into the $Th_2Zn_{17}$ type oblique hexagonal phase, but meanwhile, the proportion of the soft magnetic phase α-Fe is increased. After the magnetic powder is used for preparing a bonded magnet, the irreversible flux loss of the samarium-iron-nitrogen magnet is reduced. By adjusting the temperature and the time for the crystallization heat treatment of the quick-quenched SmFe to improve the proportion of the $Th_2Zn_{17}$ type structure in the $TbCu_7$ type SmFe alloy, the highly thermostable samarium-iron-nitrogen magnetic material can be obtained.

In the present application, the main phase of the material is the $TbCu_7$ type structure, the intrinsic magnetic property of the samarium-iron-nitrogen magnetic powder having the structure is higher than the quick-quenched NdFeB magnetic powder, and the corrosion resistance is also better than other magnetic powder. The samarium iron in the $TbCu_7$ type structure is of a metastable phase and its formation requires strict component control and process condition control as well as a quick cooling manner. However, in preparation, there also have compounds with other structures, such as $ThMn_{12}$ or $Th_2Ni_{17}$ or $Th_2Zn_{17}$ structure. The samarium-iron alloy prepared by melt quick quenching is of a $Th_2Zn_{17}$ structure in general, the size of the magnetic powder having such structure needs to reach to a micron level and the relatively good magnetic property is obtained by orienting compression in a magnetic field. Generally, the remanence and the magnetic energy product of the quick-quenched magnetic powder having the $Th_2Zn_{17}$ structure are quite low, and even are less than 8 MGOe, but the coercivity $H_{cj}$ may be up to 20 kOe or more. The samarium iron having the $TbCu_7$ structure is of the metastable phase and may be transformed into the $Th_2Zn_{17}$ structure via a certain crystallization heat treatment and nitrizing treatment, and meanwhile, the soft magnetic phase α-Fe is also produced. As a result, there are excessive stable $Th_2Zn_{17}$ structures due to the overhigh temperature of the heat treatment and therefore the magnetic property is greatly reduced. According to the present application, by optimizing the crystallization process, adjusting the contents of the $Th_2Zn_{17}$ structure phase and the α-Fe soft magnetic phase in the alloy, and specifying that the content of the α-Fe soft magnetic phase is less than 5% and that of the $Th_2Zn_{17}$ structure phase is 1% or more, the $TbCu_7$__ structure phase is the main phase and its content is 50% or more, the preferable temperature of the crystallization heat treatment is 700-900° C.

According to the present application, it is also specified that the samarium-iron-nitrogen magnetic material is 10-40 μm in an average thickness and consists of nanocrystals having the average size of 10-200 nm. As the thickness of the quick-quenched samarium-iron alloy is associated with the preparation method, the $TbCu_7$ structure needs a large cooling speed and the overquick cooling speed is not beneficial to the formation of the ribbon, the thickness of the prepared samarium-iron alloy is at the specified appropriate thickness. The grain size of the magnetic powder directly affects the magnetic property, the alloy with small and uniform grains has relatively high coercivity and the thermostability of the magnetic powder also can be improved. Generally, the magnetic powder having the grain size kept between 10 nm and 1 μm can obtain the relatively good magnetic property. To enable the magnetic powder to keep the relatively good coercivity and improve the thermostability, the grain size of the magnetic powder is preferably 10-200 nm.

Embodiments 1-15

The preparation method includes the following steps:

(1) after mixing metals listed in each embodiment according to a proportion in Table 1, putting into an induction smelting furnace, and smelting under Ar gas protection to obtain an alloy ingot;

(2) after roughly crushing the alloy ingot, putting into a quick quenching furnace, wherein the protective gas is an Ar gas, the spray pressure is 80 kPa, the nozzle diameter is 0.8 and the speed of a water cooling roller is 20-80 m/s; and quickly quenching to obtain flaky alloy powder;

(3) after performing a heat treatment on the alloy under the Ar gas protection, performing a nitriding treatment under a $N_2$ gas at 1 atm to obtain nitride magnetic powder, wherein the conditions for the heat treatment and the nitriding treatment in crystallization are referred to Table 2; and (4) detecting a phase proportion and a magnetic property of the nitride magnetic powder.

TABLE 1

| Embodiment | Component |
|---|---|
| 1 | $Sm_{8.5}Zr_{1.2}Fe_{77.7}Si_{1.0}N_{11.6}$ |
| 2 | $Sm_{8.5}Zr_{1.2}Fe_{76.9}Al_{1.0}N_{12.4}$ |
| 3 | $Sm_{8.5}Zr_{1.2}Fe_{79.2}Mn_{1.0}N_{10.1}$ |
| 4 | $Sm_{8.5}Zr_{1.2}Fe_{72.3}Co_{4.5}N_{13.5}$ |
| 5 | $Sm_{8.5}Zr_{1.2}Fe_{73.3}Co_{4.5}N_{12.5}$ |
| 6 | $Sm_{8.5}Hf_{1.2}Fe_{74.3}Co_{4.5}N_{11.5}$ |
| 7 | $Sm_{8.5}Zr_{1.2}Fe_{82.8}Co_{4.5}Nb_{1.2}N_{1.8}$ |
| 8 | $Sm_{8.5}Zr_{1.2}Fe_{73.4}Co_{4.5}Ti_{1.2}N_{11.2}$ |
| 9 | $Sm_{8.5}Zr_{1.2}Fe_{73.8}Co_{4.5}Mo_{1.2}N_{10.8}$ |
| 10 | $Sm_{8.5}Hf_{1.2}Fe_{73.7}Ni_{4.5}N_{12.1}$ |
| 11 | $Sm_{8.5}Zr_{1.2}Fe_{77.6}Ga_{0.3}N_{12.4}$ |
| 12 | $Sm_{8.5}Zr_{1.2}Fe_{75.8}V_{1.5}N_{13}$ |
| 13 | $Sm_{8.5}Zr_{1.2}Fe_{75.3}Nb_{1.5}N_{13.5}$ |
| 14 | $Sm_{8.5}Zr_{1.2}Fe_{78.3}Cr_{1.5}N_{10.5}$ |
| 15 | $Sm_{8.5}Zr_{1.2}Fe_{74.9}Cr_{1.5}N_{13.9}$ |

TABLE 2

| Embodiment | Crystallization heat treatment | Nitriding treatment | Proportion of $TbCu_7$ type phase | Proportion of $Th_2Zn_{17}$ type phase | Proportion of α-Fe phase |
|---|---|---|---|---|---|
| 1 | 700° C. * 90 min | 350° C. * 24 h | 98.7 | | 1.3 |
| 2 | 725° C. * 80 min | 380° C. * 24 h | 97.3 | 1.4 | 1.3 |
| 3 | 750° C. * 70 min | 400° C. * 24 h | 96.2 | 2.1 | 1.7 |
| 4 | 775° C. * 60 min | 410° C. * 24 h | 92.4 | 5.5 | 2.1 |
| 5 | 800° C. * 50 min | 420° C. * 24 h | 91.5 | 6.1 | 2.4 |
| 6 | 825° C. * 40 min | 460° C. * 24 h | 87.6 | 9.1 | 3.3 |
| 7 | 850° C. * 30 min | 450° C. * 20 h | 84.4 | 11.7 | 3.9 |
| 8 | 875° C. * 20 min | 440° C. * 24 h | 78.5 | 16.6 | 4.9 |
| 9 | 900° C. * 10 min | 430° C. * 24 h | 52.4 | 38.4 | 9.2 |
| 10 | 775° C. * 70 min | 470° C. * 24 h | 91.7 | 6.0 | 2.3 |
| 11 | 800° C. * 60 min | 510° C. * 16 h | 89.2 | 7.9 | 2.9 |
| 12 | 825° C. * 50 min | 500° C. * 24 h | 84.2 | 12.3 | 3.5 |
| 13 | 850° C. * 40 min | 400° C. * 30 h | 65.3 | 29.8 | 4.9 |
| 14 | 875° C. * 30 min | 450° C. * 24 h | 51.2 | 44.4 | 4.4 |
| 15 | 900° C. * 20 min | 600° C. * 12 h | 50.0 | 45.1 | 4.9 |

Performance Test

The performance test is performed on the permanent magnetic material obtained in the embodiments 1-15 and the test results are referred to Table 3 hereinafter

TABLE 3

| Embodiment | Br/kGs | Hcj/kOe | (BH)m/MGOe | 2 h@120 FL % |
|---|---|---|---|---|
| 1 | 9.1 | 9.5 | 16.2 | 6.1 |
| 2 | 9.7 | 9.8 | 16.5 | 4.9 |
| 3 | 9.3 | 10.3 | 16.2 | 3.8 |
| 4 | 9.2 | 10.9 | 15.3 | 3.4 |
| 5 | 8.9 | 11.2 | 15.4 | 3.2 |
| 6 | 8.6 | 12.1 | 14.5 | 3.2 |
| 7 | 8.3 | 13.0 | 14.2 | 3.4 |
| 8 | 8.5 | 12.5 | 14.2 | 3.4 |
| 9 | 7.9 | 11.8 | 12.9 | 5.7 |
| 10 | 8.9 | 11.4 | 15.8 | 3.3 |
| 11 | 8.6 | 11.6 | 15.1 | 3.6 |
| 12 | 8.5 | 11.3 | 14.0 | 3.5 |
| 13 | 8.4 | 12.6 | 14.1 | 4.5 |
| 14 | 8.3 | 12.1 | 13.4 | 4.3 |
| 15 | 7.8 | 10.9 | 12.2 | 5.1 |

2 h@120 FL % is the irreversible flux loss with exposure for 2 h in the air at 120° C.

The high thermostability of the magnetic powder prepared in the embodiments is characterized by the irreversible flux loss of the bonded magnet and by exposing the bonded magnet for 2 h in the air at 25-120° C.

It may be seen from the Table 2 that the proportions of the $TbCu_7$ type phase, the $Th_2Zn_{17}$ type phase and the α-Fe phase in the embodiment 1 and the embodiment 9 are not within the preferable ranges of the claims, so the performance is slightly poor. The irreversible flux loss of the magnetic powder prepared in the rest embodiments basically is less than 5%, the magnetic property Hcj substantially is up to 10 kOe or more, and the magnetic energy product BH is up to 12 MGOe or more.

Obviously, the above embodiments are examples only intended to illustrate the present application clearly, rather than limits to the embodiments. A person having ordinary skill in the art further can make changes or modifications in other different forms on the basis of above description. Here, there is no necessity and no need to give an example for all embodiments one by one. And any obvious change or modification hereto shall all fall within the protection scope of the present application.

What is claimed is:

1. A rare-earth permanent magnetic material, a composition of the rare-earth permanent magnetic material by an atomic percentage being as follows:

$Sm_xR_aFe_{100-x-y-z-a}M_yN_z$ wherein R is at least one of Zr and Hf, M is at least one of Cr, V, Mo, Ni, and Mn, $7\% \leq x+a \leq 10\%$, $0<a\leq 1.5\%$, $0<y\leq 5\%$, $10\% \leq z \leq 14\%$, wherein the rare-earth permanent magnetic material comprises a $TbCu_7$ phase, a $Th_2Zn_{17}$ phase and a soft magnetic phase α-Fe, wherein a content of the TbCu7 phase in the rare-earth permanent magnetic material is 80% or more, and a content of the soft magnetic phase α-Fe in the rare-earth permanent magnetic material is 0-5%, excluding 0, wherein the magnetic property Hcj of the rare-earth permanent magnetic material is 10 kOe or more and the magnetic energy product Bh is 14 MGOe or more.

2. A preparation method of the rare-earth permanent magnetic material as claimed in claim 1, comprising the following steps:

(1) performing master alloy melting on Sm, R, Fe, and M;

(2) quick-quenching a master alloy obtained in the step (1) to prepare a quick-quenched ribbon;

(3) performing a crystallization treatment on the quick-quenched ribbon obtained in the step (2); and (4) nitriding a permanent magnetic material crystallized in the step (3) to obtain the rare-earth permanent magnetic material, wherein the performing the crystallization treatment on the quick-quenched ribbon obtained in the step (2) comprises: wrapping the quick-quenched ribbon, then performing a heat treatment and then a quenching treatment, wherein the quenching treatment employing a water-cooling manner in an argon atmosphere, and wherein the heat treatment is performed in a tubular resistance furnace and in an argon atmosphere.

3. The preparation method as claimed in claim 2, wherein the melting in the step (1) is performed by means of an electric arc; and an ingot obtained by the melting is preliminarily crushed into millimeter-level ingot blocks.

4. The preparation method as claimed in claim 2, wherein the quick-quenching in the step (2) is as follows:

putting the master alloy into a quartz tube having a nozzle; and melting into an alloy liquid via induction melting, and spraying to a rotary water-cooling copper mould via the nozzle to obtain the quick-quenched ribbon; and a wheel speed in the quick-quenching is 20-80 m/s.

5. The preparation method as claimed in claim 2, wherein the nitriding in the step (4) is performed in a nitriding furnace.

6. A magnet, comprising the rare-earth permanent magnetic material as claimed in claim 1, wherein the irreversible flux loss of a magnet prepared from the rare-earth permanent magnetic material is less than 5% when exposing for 2 h in the air at 120° C.

7. The magnet as claimed in claim 6, wherein the magnet is formed by bonding the rare-earth permanent magnetic material and an adhesive, the magnet prepared with the following method: mixing the rare-earth permanent magnetic material with an epoxy resin to obtain a mixture, adding a lubricant to the mixture, then performing a treatment to obtain a bonded magnet, and at last thermocuring the bonded magnet.

8. The magnet as claimed in claim 7, wherein a proportion of the rare-earth permanent magnetic material to the epoxy resin by weight is 100:1-10.

9. The preparation method as claimed in claim 3, wherein the quick-quenching in the step (2) is as follows: putting the master alloy into a quartz tube having a nozzle, melting into an alloy liquid via induction melting, and spraying to a rotary water-cooling copper mould via the nozzle to obtain the quick-quenched ribbon.

10. The rare-earth permanent magnetic material as claimed in claim 1, wherein the rare-earth permanent magnetic material is composed of crystal grains having an average size of 10 nm to 1 μm.

11. The preparation method as claimed in claim 2, wherein a temperature of the heat treatment is 700-900° C. and a time is 5 min or more.

12. The preparation method as claimed in claim 5, wherein the nitriding is performed in a high-purity nitrogen atmosphere at 1-2 atm.

13. The preparation method as claimed in claim 5, wherein a temperature of the nitriding is 350-600° C. and a time is for 12 h or more.

14. The magnet as claimed in claim 8, wherein an added amount of the lubricant is 0.2-1 wt %.

* * * * *